United States Patent [19]

Brauch et al.

[11] Patent Number: 4,658,743

[45] Date of Patent: Apr. 21, 1987

[54] CONTROL MECHANISM FOR SEWING MACHINE STITCH FORMING MECHANISM

[75] Inventors: Robert B. Brauch, Wayne; Pao-Ter Huang, Edison, both of N.J.

[73] Assignee: The Singer Company, Stamford, Conn.

[21] Appl. No.: 840,236

[22] Filed: Mar. 17, 1986

[51] Int. Cl.[4] ..... D05B 3/06

[52] U.S. Cl. ..... 112/448; 112/466

[58] Field of Search ..... 112/466, 448, 465

[56] References Cited

U.S. PATENT DOCUMENTS

| | | | |
|---|---|---|---|
| 4,077,341 | 3/1978 | Kasuga | 112/466 X |
| 4,428,311 | 1/1984 | Sano | 112/466 |
| 4,553,491 | 11/1985 | Brauch et al. | 112/465 |
| 4,577,575 | 3/1986 | Stevens et al. | 112/449 |

*Primary Examiner*—Werner H. Schroeder
*Assistant Examiner*—Andrew M. Falik
*Attorney, Agent, or Firm*—Robert E. Smith

[57] ABSTRACT

A sewing machine having feed control linkage spring biased in one direction and manual selector cams effecting feed control linkage settings in buttonhole stitch formation, one selector cam including a projection effecting abnormal control linkage position from which the control linkage shifts to final setting in the spring bias direction.

3 Claims, 5 Drawing Figures

CONTROL MECHANISM FOR SEWING MACHINE STITCH FORMING MECHANISM

BACKGROUND OF THE INVENTION

1. Field of the Invention

This invention relates to sewing machines having stitch forming mechanism which may be controlled to produce a succession of different ornamental stitch configurations together defining a stitch pattern and, more particularly, to sewing machines capable of producting such stitch patterns as honeycomb patterns or buttonhole stitch patterns in which accuracy of control of the different stitch configurations defining the stitch pattern critically influences the appearance of the pattern.

2. Description of the Prior Art

This invention, as applied to the four-step buttonhole mechanism of a sewing machine, is an improvement of the U.S. Pat. No. 4,553,491 of R. B. Brauch et al, Nov. 19, 1985, which discloses the closest prior art of which we are aware.

In the U.S. Pat. No. 4,553,491, the density of zigzag stitching along the opposite sides of the buttonhole is influenced by rendering effective forward or reverse feed cams, respectively, from the barring stitch forming condition controlled by a barring stitch feed cam. Since the buttonhole side stitches are arranged laterally opposite each other, even slight differences in density therebetween are noticeable. Using the mechanism disclosed in U.S. Pat. No. 4,553,491, a noticeable variation in buttonhole side stitch density can be obtained. This invention relates to the recognition of the cause of such variation, and novel and effective measures for obviating it.

SUMMARY OF THE INVENTION

The stitch density control in sewing mechanism, such as disclosed in U.S. Pat. No. 4,553,491, involves linkage extending from the bracket arm to the bed of the sewing machine with an inevitable accumulation of tolerances. In the construction taught in U.S. Pat. No. 4,553,491, the transition from barring stitch configuration to each of the forward and reverse fed side stitch legs of the buttonhole shifts the stitch density control linkage in opposite directions. The regulating mechanism for the work feed of the sewing machine is spring biased in one direction so that in the transitition from barring stitch configuration to side stitching in that one direction, the spring bias of the work feed mechanism will influence the tolerance disposition of the stitch density control linkage, while in the transition from barring stitch configuration to side stitching in the opposite direction, it is the operation of the selecting mechanism in opposition to the spring bias which influences the tolerance disposition and, in particular, the speed at which the selection is made can modify the resulting stitch density on that leg of the buttonhole.

The present invention obviates this possible source of stitch density variation in buttonhole formation by providing a uniquely formed selector cam effective during transition from barring stitch mode to that direction of side stitching on which the feed regulating spring bias is opposed, the unique selector cam being formed so as to shift the follower mechanism initially to a position beyond that ultimately necessary for the required side stitching and then so that the follower will be returned to ultimate position by action of the feed regulator spring bias. Consequently, the stitch density control linkage will be positioned in response to the identical spring bias in preparation for buttonhole side stitching in each direction of feed and identical accumulation of tolerances will be obtained resulting in greater uniformity of stitch density in the buttonhole side stitching.

This novel and effective technique may be utilized for maximizing the uniformity of control linkage setting influencing any sewing machine stitch forming instrumentality where the accuracy of the setting is especially critical to the appearance of the stitch pattern. Honeycomb stitch patterns exemplify this type of critical pattern in which sinuous lines of zigzag stitching must repeatedly close or cross in a geometric pattern which highlights even slight variation.

DETAILED DESCRIPTION

A preferred embodiment of this invention will be described hereinbelow as applied to a four-step buttonhole mechanism of a sewing machine.

Figure 1:
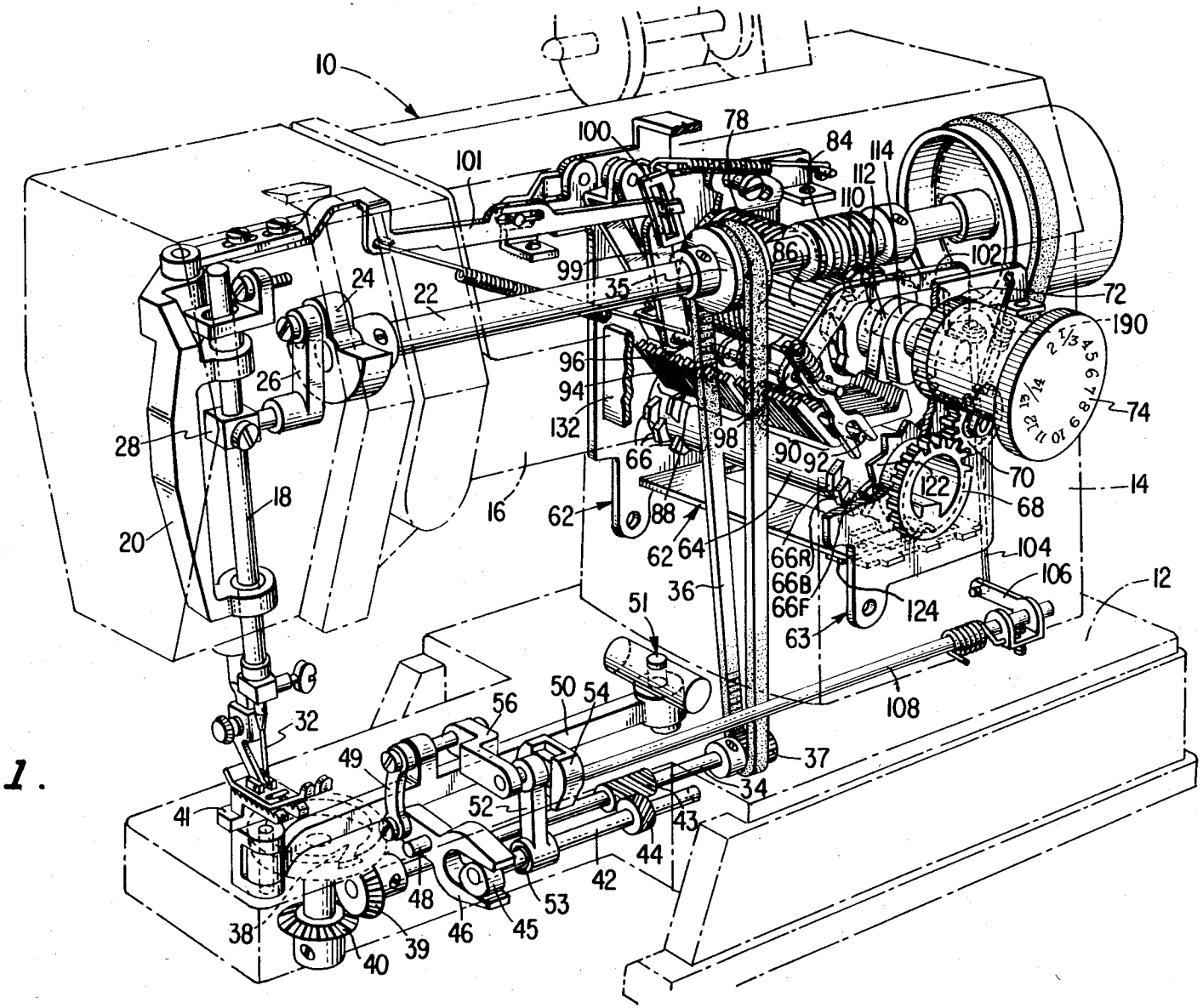
FIG. 1 is a diagrammatic perspective view of a sewing machine of the type to which this invention may be applied.
Figure 2:
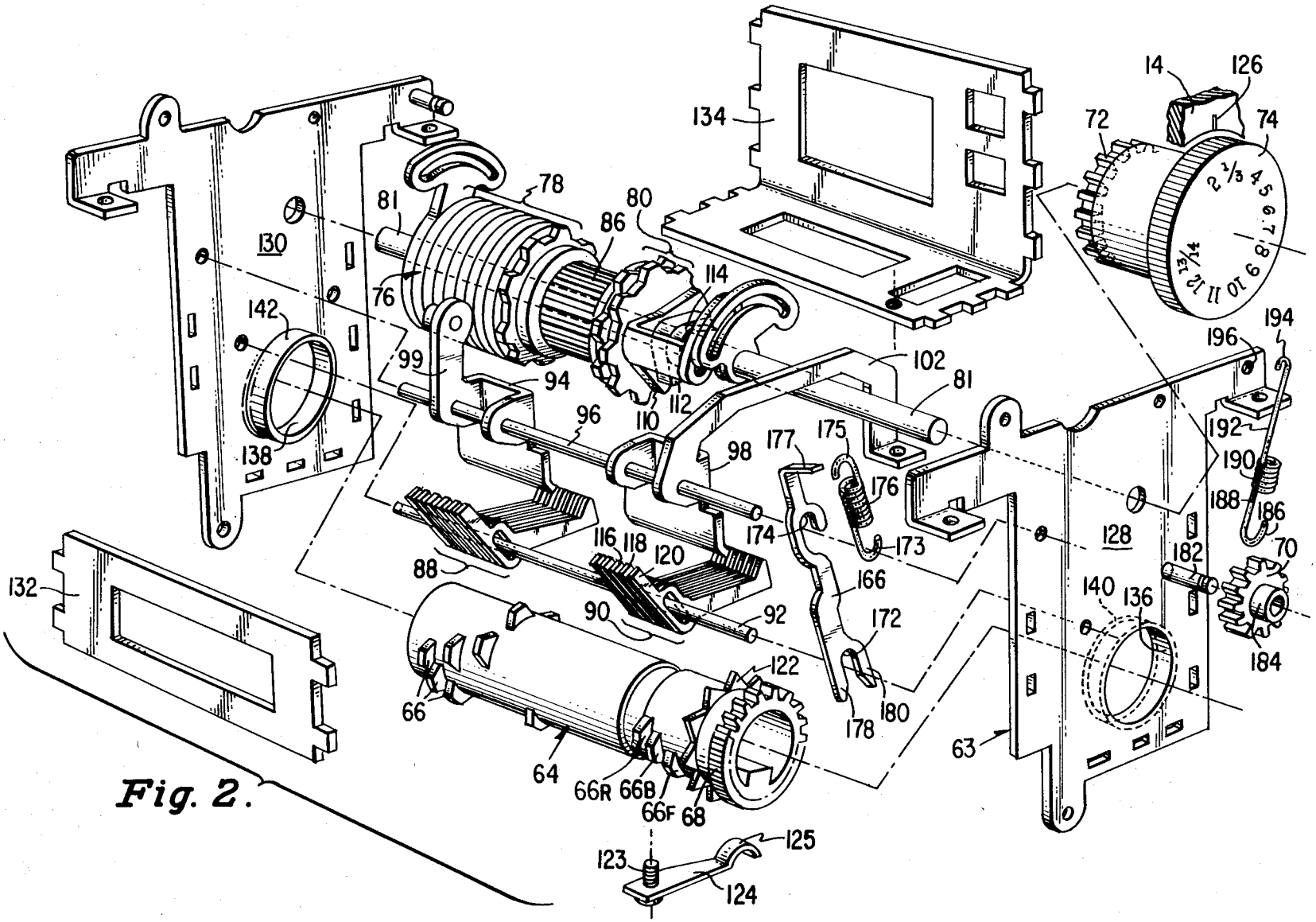
FIG. 2 is an exploded perspective view of the modular control unit of the sewing machine of FIG. 1 with this invention applied thereto.

Referring particularly to FIGS. 1 and 2 of the drawings, reference character 10 designates a sewing machine of the type to which this invention is adapted to be applied. The sewing machines includes a bed 12, a standard 14 rising from the bed, and a bracket arm 16 overhanging the bed. A needle bar 18 is supported in a gate 20 for endwise reciprocation by an arm shaft 22 acting through a crank 24, drive link 26 and a needle bar attached collar 28. The gate is conventionally mounted in the machine for pivotal movement effective to laterally jog the needle bar 18 and needle 32 affixed therein. A bed shaft 34 is rotatable by the arm shaft 22 acting through a sprocket 37 on the bed shaft. A looptaker 38 is rotatable in timed relation to endwise reciprocation of needle 32 by the bed shaft acting through gears 39 and 40. The machine includes mechanism of a well known type for imparting work transporting movement to a feed dog 41. Such mechanism includes a feed drive shaft 42 driven by gears 43 and 44 from the bed shaft, a feed lift cam 45 on the feed drive shaft, a lever 46 embracing cam 45 and pivoted at 48 in the bed of the machine, a link 49 connecting lever 46 with a feed bar 50 supported on gimbles 51, a pitman 52 driven by an eccentric 53 on shaft 42 and connected to reciprocate in a slideblock 54, and a link 56 which pivotally connects pitman 52 with feed bar 50. The magnitude and direction of work feeding feed dog movements of feed dog 41 are determined by the inclinatin of slideblock 54.

Reference character 63 designates the frame of a module wherein mechanism for controlling pattern and buttonhole sewing is located. Such control mechanism includes a cam selecting rotatable drum 64 with radially projecting fingers 66 that are spaced apart from one another both longitudinally and circumferentially on the drum. The drum includes a gear 68 which is engaged by an idler gear 70. The idler gear meshes with a gear 72 which is rotatable by a dial 74. Drum 64 may therefore be rotationally positioned by operation of the dial.

The control mechanism also includes a drum 76 with needle bight controlling cams 78 as well as cams 80 thereon for influencing varying patterns of work feed movement. Drum 76 is rotatably supported on a fixed shaft 81 for continuous rotation by arm shaft 22 acting through a worm 84 on the arm shaft and a gear 86 on the drum. Cam followers 88 and 90, pivotally mounted on a fixed shaft 92, are selectively positionable by fingers 66 on cam selecting drum 64 against the needle bight and feed controlling cams 78 and 80, respectively, on drum 76. Cam followers 88 are associated with an actuator 94 pivoted on a fixed shaft 96, and cam followers 90 are associated with an actuator 98 which is also pivoted on shaft 96. Whenever a cam follower is positioned by a finger on selecting a drum 64 against a cam on drum 76, such cam follower is also caused to engage its associated actuator 94 or 98, and the actuator is moved by the cam follower according to the profile of the cam during rotation of drum 76. Actuator 94 connects through an arm 99 thereon, a link 100, and a link 101 with needle bar gate 20 to control lateral movement of the needle, whereas actuator 98 connects through links 102, 104 and rock arm 106 with a rock shaft 108 to control movement of slideblock 54 affixed thereon, and thereby working feeding movements of feed dog 41.

A coil spring 109 is coiled about the rock shaft 108 and bears at the one extremity against the sewing machine bed, and at the other extremity on the rock arm 106 to bias the rock arm 106 in a counterclockwise direction as viewed in FIG. 1. The spring 109 biases the feed control mechanism toward the forward direction of work feed.

The control mechanism further includes frame affixed cams 110, 112 and 114 on shaft 81. Cam followers 116, 118 and 120 pivotally moveable on shaft 92 are selectively positionable against cams 110, 112 and 114, respectively, by three of the fingers 66 on the drum 64 which are labeled 66F, 66B and 66R, respectively; 66F to indicate selection of feed appropriate for side stitching in the forward direction, 66B to indicate selection of feed for barring stitch formation, and 66R to indicate selection of feed appropriate for side stitching in the reverse direction. Cam followers 116, 118 and 120 are associated, as are the other feed cam followers 90, with actuator 98.

Frame 62, wherein the described mechanism for controlling pattern and buttonhole sewing is located, includes front and back sheet metal plates 128 and 130, respectively, which are held in an assembled relationship with connecting plates 132 and 134. Drum 64 is rotatably supported at punched out holes 136 and 138 in the front and back plates on flanges 140 and 142 formed in the punching process. Although punched holes are necessarily somewhat imprecise and drum 64 may be only loosely supported therein, a single stablized position for the drum in all of its indexed positions is obtained with a spring biased member 166. Member 166 is slidably mounted at the rear side of the plate 128 on shafts 92 and 96 extending into slots 172 and 174 in the member. A spring 176 having one end 173 curled about shaft 96 and the other end 175 curled about an end tab 177 on member 166 biases the member toward drum 64 causing forked spaced apart portions 178 and 180 at the opposite end of the member from tab 177 to forcibly bear against the surface of the drum, and establish a location for the drum in indexed cam selecting positions. Consistency in the stitches in any cam selecting position of drum 64 is thereby assured.

Idler gear 70 is loosely mounted for rotation on a stub shaft 182 affixed in plate 128, and is engaged at a hub 184 by a hooked end 186 of an extended linear end portion 188 of a coil spring 190. An opposite linear end portion 192 of the spring is hooked at 194 through a hole 196 in plate 128. Spring 190 biases idler gear 70 in a direction away from gear 68 to provide a loose meshing relationship with gear 68. Such loose meshing relationship between gears 68 and 70 results in some circumferential play in dial 74 in the cam selecting indexed positions of drum 64, and so provides a feeling of placement to an operator of the dial, indicating when movement of the dial has resulted in the attainment of a cam selecting position by drum 64.

A bidirectional ratchet wheel 122 on drum 64, and a detent spring 124 having one end secured by a screw 123 in frame 62 and the other end 125 in engagement with the wheel indexes drum 64 into cam selecting positions corresponding to positions of alignment of indications on the dial 74 with a mark 126 on standard 14. In each of the positions of alignment of dial indications 5 through 10 with mark 126, drum 64 is disposed to select a particular cam 78 for the sewing of a bight controlled pattern defined thereby, whereas in each of the positions of alignment of dial indiations 11 through 14 with mark 126, both a particular cam 78 and a particular cam 80 are selected for the sewing of a bight and feed controlled pattern.

In aligned positions 1 and 3 of the dial 74 with mark 126, a cam 78 is rendered effective by activation of an appropriate follower 88 by a selector cam 66, and cam 112 is rendered effective by selector cam 66B contacting and shifting cam follower 118 into active position thus to provide for the formation of barring stitches at opposite ends of the buttonhole.

Figure 3:
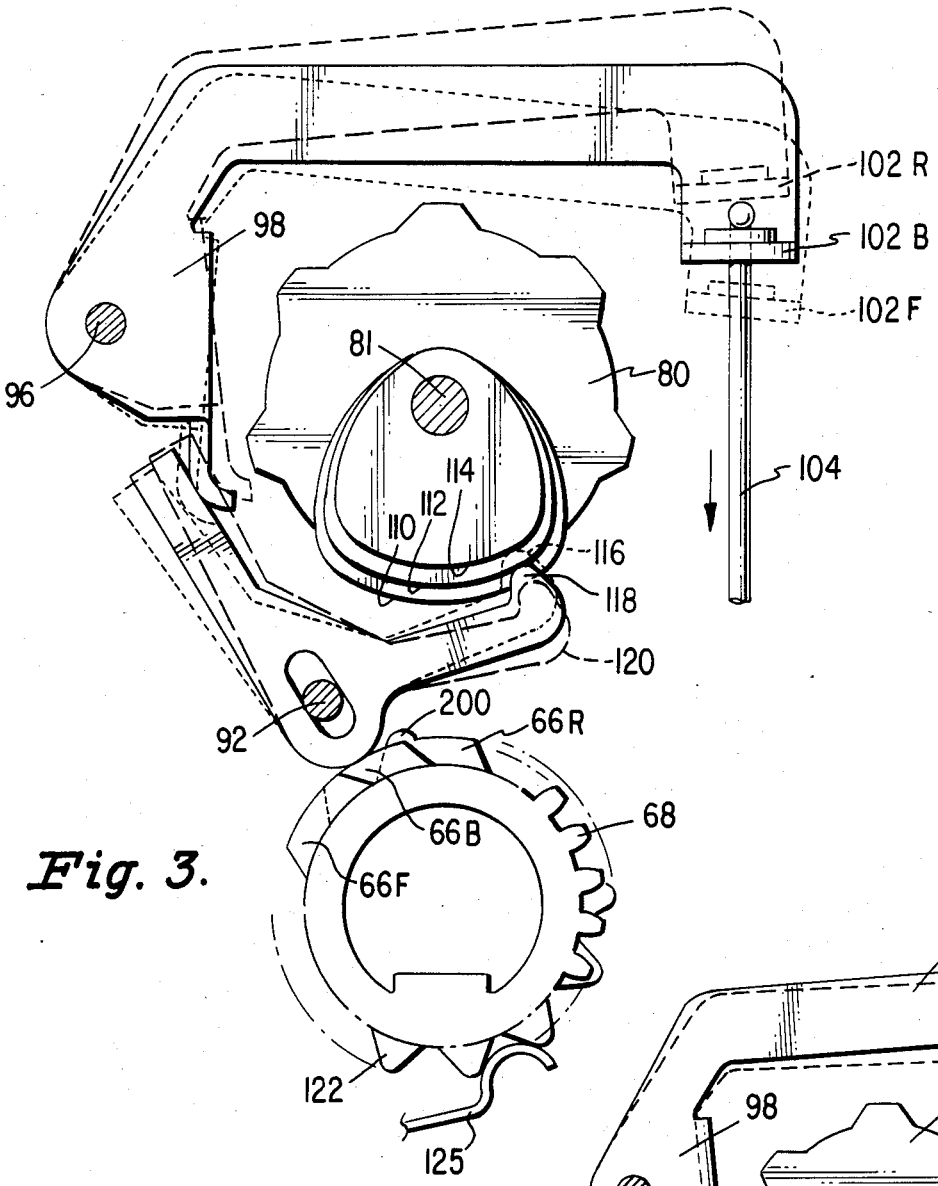
FIG. 3 is an elevational view of a portion of the work feed controlling mechanism during buttonhole stitching showing each of the cam followers and the control linkage positions when each of the buttonholing feed cams is effective.
Figure 5:
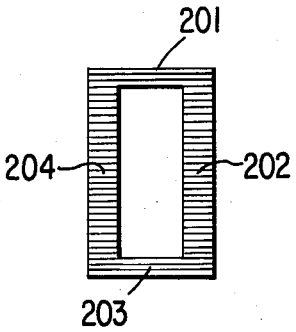
FIG. 5 is a representation of the stitched buttonhole produced by the mechanism in accordance with this invention.

In FIG. 5, such barring stitches are indicated at 201 and 203 and are characterized by a bight of zigzag stitches as wide as the total width of the buttonhole and substantially zero stitch length. In FIG. 3, the position of the cam follower 118 when activated for barring stitch formation is illustrated in solid lines as is the related position of the feed actuator 98 and link 102. which is labeled 102B in the barring stitch position in FIG. 3.

In aligned position 2 of the dial 74 with the mark 126, another zigzag influencing cam 78 is selected so as to produce narrow zigzag stitches at one side of the zigzag stitch range and cam 114 is rendered effective by selector cam 66F contacting and shifting cam follower 120 into active position thus to provide for the formation of stitches indicated at 202 in FIG. 5 along one side of the buttonhole with forward feeding of material under the needle 32.

In FIG. 3, the position of the cam follower 120, when activated, is illustrated in dotted lines as is the related position of the feed actuator 98 and link 102, which is labeled 102F. It will be appreciated that the link 102 is depressed below its position during barring stitch formation when forward feed is influenced by selector cam 66F and cam follower 120.

After completion of the desired length of side stitches 202, the dial 74 is shifted back to position 1 and 3 for formation of barring stitches at the other end of the buttonhole as explained above placing the link 102 in the position labeled 102B in FIG. 3 following which the dial is shifted to position 4.

In aligned position 4 of the dial 74 with the mark 126, another zigzag influencing cam 78 is selected so as to provide narrow zigzag stitches at the opposite side of the zigzag stitch range, and cam 110 is rendered effective by selector cam 66R contacting and shifting cam follower 116 into effective position thus to provide for the formation of stitches indicated at 204 in FIG. 5 along the opposite side of the buttonhole with the reverse feeding of material under the needle.

In FIG. 3, the position of the cam follower 116, when fully activated, is illustrated in dashed lines as is the related position of the feed actuator 98 and the link 102, which is labeled 102R. As shown, the link 102 in position 102R when reverse feed is influenced by selector cam 66R and cam follower 116 is elevated above its position 102B during barring stitch formation.

In FIG. 3, an arrow along the element 104 indicates the direction of force exerted on the link 102 by the bias of the spring 109. It will be appreciated that, in the transition from barring stitch formation in which line 102 is shown in solid lines and labeled 102B to side stitching in the forward direction of feed in which the link 102 is shown in dotted lines and labeled 102F, the link 102 is moved by the spring 109 in the direction of the force exerted by the spring bias. It has been found that when a spring biased linkage is moved into position in the direction in which the force is exerted by the spring bias, the linkage is particularly immune to final position variation and, when such transition is repeated, the accumulation of tolerances in the feed controlling linkage will be substantially the same.

In transition from barring stitch formation to reverse direction side stitching, however, the link 102, labeled 102R as shown in dashed lines in FIG. 3, moves opposite the direction of spring force. Forces external to the constant value of the bias of spring 109 influence such transition to the reverse direction of feed.

It has been found that movement of the spring biased linkage directly into final position in a direction opposite that in which the force is exerted by the spring bias subjects the linkage to undesirable variation in final position apparently stemming from variations in forces and the resulting effect on frictional resistances in the linkage, depending, for instance, on the speed with which an operator makes the selection, and the influence thereof on the accumulation of tolerances in the linkage.

To alleviate this possible source of stitch density variation, this invention provides on the selector cam 66R a projection 200 so positioned on the cam 66R that, as the dial is shifted from the position 1 and 3 to the position 4 in alignment with mark 126, the projection 200 will influence a preliminary overshift of the cam follower 116 beyond its ultimate position thus causing the link 102 to be elevated temporarily to a position higher than that of the dashed line position labeled 102R shown in FIG. 3 and then brought into the dashed line position by a movement in the direction of the spring 109 force.

Figure 4:
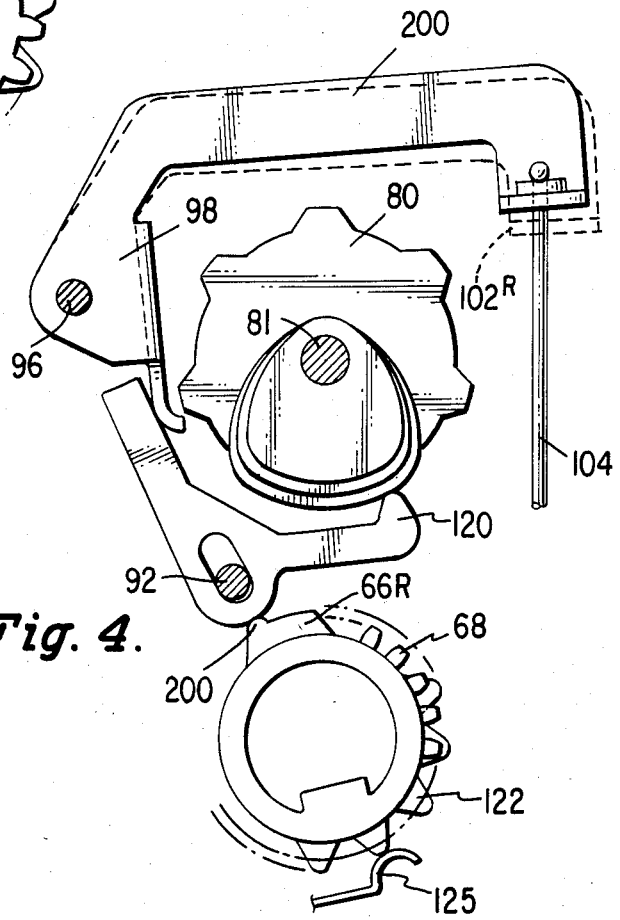
FIG. 4 is an elevational view similar to FIG. 3, but showing only that cam follower for influencing reverse direction of feed during buttonhole side stitching together with the selecting finger therefor during the initial movement of the selecting finger toward its final effective position, and for comparison showing a fragment of the feed control linkage in the position which it occupies when the cam follower for influencing reverse direction of feed reaches its final effective position.

FIG. 4 illustrates the position of the cam 66R and the follower 116 as the cam 66R makes initial contact with the follower 116. Upon such initial contact, the projection 200 of the cam 66R influences movement of the cam follower 116 into an abnormally elevated position similarly causing the link 102 to move higher than its final position. In FIG. 4, this abnormally higher position of the link 102 is shown in solid lines and labeled 200 whereas the position of the link 102 in its final position is shown in dotted lines and labeled 102R. It will be appreciated that, in the final position of selector cam 66R, the projection 200 will be positioned beyond and out of engagement with the follower 116.

The result of the temporary overshift of follower 116 and link 102 by the cam projection 200 is that the force of the spring 109 will be effective to move feed controlling linkage into its final position for reverse feeding as shown in dashed lines in FIGS. 3 and 4 and, therefore, the factors influencing accumulation of tolerances in the linkage will be the same in both forward and reverse direction of feed side stitched legs 202 and 204 of the buttonhole.

We claim:

1. In a sewing machine having stitch forming instrumentalities, actuating mechanism for said stitch forming instrumentalities, a control linkage for influencing selectively different conditions of operation of actuating mechanism for at least one of said stitch forming instrumentalities, spring means applying force biasing said control linkage in one direction, means for effecting transition of said control linkage from one position to new positions either in or opposite the direction of said spring biasing force from said one position, said means for effecting transition of said control linkage to a final position opposite the direction of said spring biasing force from said one position including means for initially effecting transition of said control linkage to a temporary position beyond said final position opposite the direction of said spring biasing force from said one position, and means for permitting return of said control linkage to said final position from said temporary position in the direction in which said spring bias applies a force to said control linkage.

2. In a sewing machine having stitch forming mechanism including needle jogging mechanism for sewing zigzag stitches, a reversible work feeding mechanism, a control linkage for said work feeding mechanism spring biased in one direction of work feed, and a four-step buttonhole mechanism including operator influenced means for producing in succession barring stitches substantially without work feed at one end of a buttonhole, side stitches along one side of a buttonhole in one direction of work feed, barring stitches substantially without work feed at the other end of a buttonhole, and side stitching along the other side of a buttonhole in the opposite direction of work feed, said operator influenced means shifting said control linkage into a succession of different final positions to effect said succession of different work feeds, and means associated with said operator influenced means and effective during transition from barring stitch production to side stitching production in one direction of work feed for initially effecting transition of said control linkage to a temporary position beyond said final position in the direction opposite said spring bias and then permitting return of said control linkage to final position from said temporary position in the direction of said spring bias.

3. In a sewing machine as set forth in claim 2 in which said four-step buttonhole mechanism includes three work feed magnitude and direction influencing cams, one for barring stitch production substantially without work feed, and separate cams for stitching each side of a buttonhole in opposite directions of work feed, three cam followers each cooperating with said control linkage and disposed each to track a respective one of said work feed cams, in which said operator influenced means includes selector cams for rendering any selected one of said three cam followers effective, and in which said means for initially effecting transition of said control linkage to a temporary position beyond said final position comprises a projection formed on one of said selector cams of said operator influenced means and effective to urge that cam follower with which it cooperates into said initial temporary position as said selector cam begins movement into cam follower selected position.

* * * * *